US007927112B1

(12) United States Patent
Chen

(10) Patent No.: US 7,927,112 B1
(45) Date of Patent: Apr. 19, 2011

(54) ELELCTRICAL CONNECTOR HAVING BOARD-LOCKING CONTACTS

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/791,004

(22) Filed: Jun. 1, 2010

(51) Int. Cl.
*H01R 12/00* (2006.01)

(52) U.S. Cl. ..... 439/83; 439/572; 439/733.1

(58) Field of Classification Search ..... 439/83, 439/572, 733.1, 876, 552, 554
See application file for complete search history.

(56) References Cited

U.S. PATENT DOCUMENTS

| | | | | |
|---|---|---|---|---|
| 6,254,435 | B1 * | 7/2001 | Cheong et al. | 439/637 |
| 6,558,200 | B1 * | 5/2003 | Choy | 439/637 |
| 6,832,933 | B2 * | 12/2004 | Bu et al. | 439/637 |
| 7,063,559 | B2 * | 6/2006 | Wang et al. | 439/495 |

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

An electrical connector secured to a PCB having welding areas and through holes, includes an insulative housing defining a receiving cavity and a plurality of contacts arranged in the housing. Each contact defines a contacting portion received in the receiving cavity, a soldering portion extending out of the housing to be connected with the welding area and a connecting portion perpendicular to the soldering portion which is connecting the contacting portion and the soldering portion. At least one contact further includes a board-lock portion bending from a distal end of the soldering portions which is adapted for inserting in the through hole of the PCB.

12 Claims, 4 Drawing Sheets

ELELCTRICAL CONNECTOR HAVING BOARD-LOCKING CONTACTS

BACKGROUND OF THE INVENTION

1. Field of the Invention

The present invention relates to an electrical connector, and more particularly to an electrical connector having contacts which have a board-lock portion to further secure the electrical connector to a print circuit board.

2. Description of the Related Art

A conventional electrical connector comprises an insulative housing and a plurality of contacts received in the housing. The electrical connector is welded to a PCB (print circuit board) and connecting with a matched electrical connector to electrically connect with said two electrical arrangements. During the connection with the matched electrical connector, the electrical connector might release from the PCB due to a mating force.

In view of the above, a new electrical connector that overcomes the above-mentioned disadvantages is desired.

SUMMARY OF THE INVENTION

Accordingly, an object of the present invention is to provide an electrical connector having contacts which have a board-lock portion to further secure the electrical connector to a PCB.

To fulfill the above-mentioned object, an electrical connector secured to a PCB having welding areas and through holes, comprising: an insulative housing defining a receiving cavity; a plurality of contacts arranged in the housing and each defining a contacting portion received in the receiving cavity, a soldering portion extending out of the housing to be connected with the welding area and a connecting portion perpendicular to the soldering portion which is connecting the contacting portion and the soldering portion; wherein at least one of said contacts further comprises a board-lock portion bending from a distal end of the soldering portions which is adapted for inserting in the through hole of the PCB.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
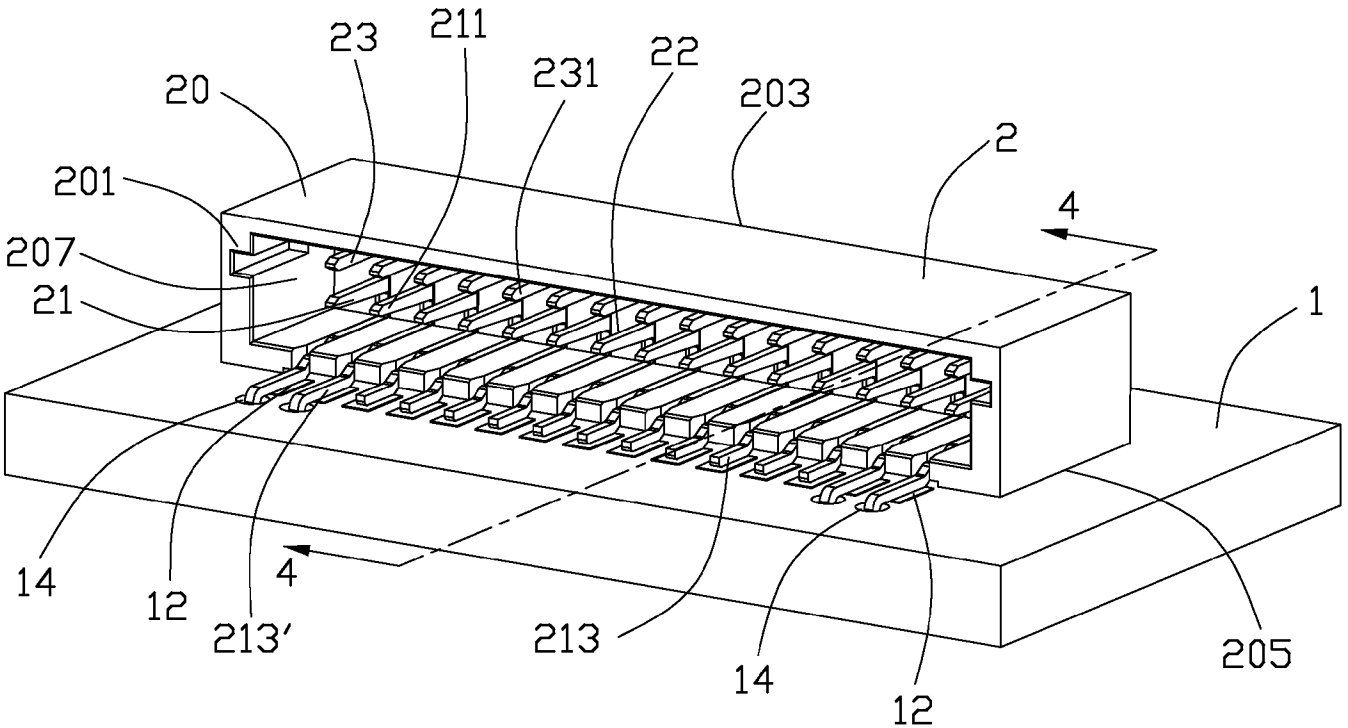
FIG. 1 is a top and front perspective view of an electrical connector welding to a PCB of the present invention.

Referring to FIG. 1, an electrical connector (2) secured to a PCB (1) comprises an insulative housing (20) and a plurality of contacts (22) received in the housing. The PCB (1) comprises a plurality of welding areas (12) on an upward face and a plurality of through holes (14) running through the PCB (1) from the upward face and locating in front of the wedding areas (12).

Figure 2:
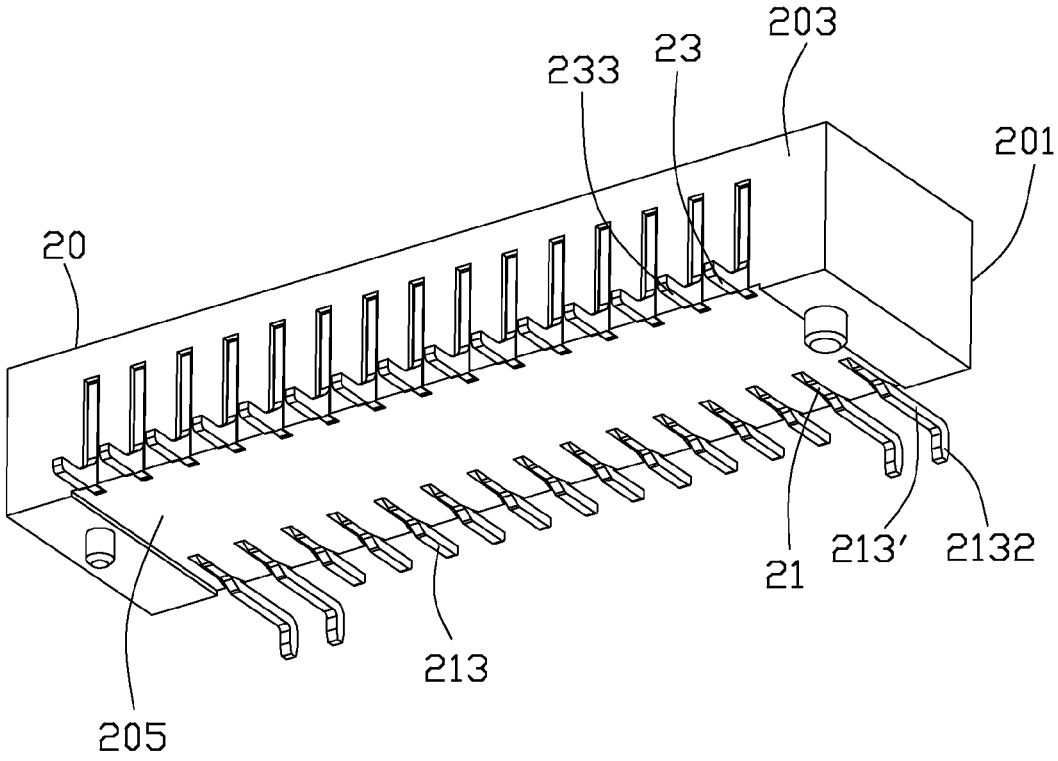
FIG. 2 is a bottom and rear perspective view of the electrical connector.

Referring to FIGS. 1-2, the housing (20) defines a front or mating face (201), a rear face (203) opposite to the mating face, and a bottom or mounting face (205) bridging the mating face and the rear face and fixed on the upward face of the PCB (1). A receiving cavity (207) is formed from the mating face (201) to the rear face (203) and running through the mating face (201).

Figure 3:
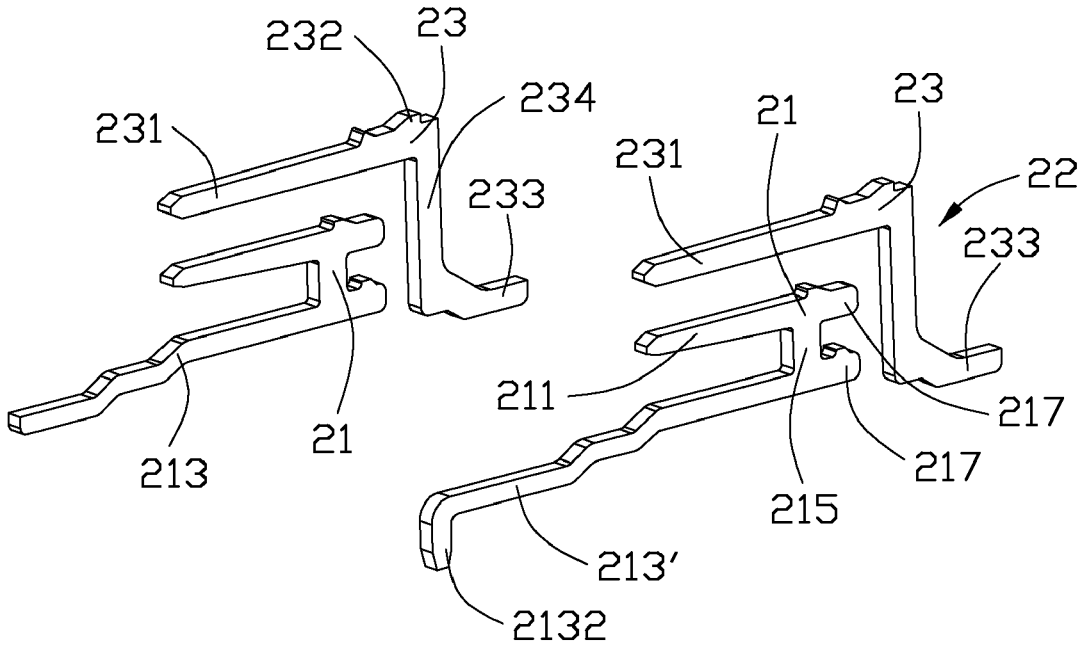
FIG. 3 is a larger view of contacts of the electrical connector.
Figure 4:
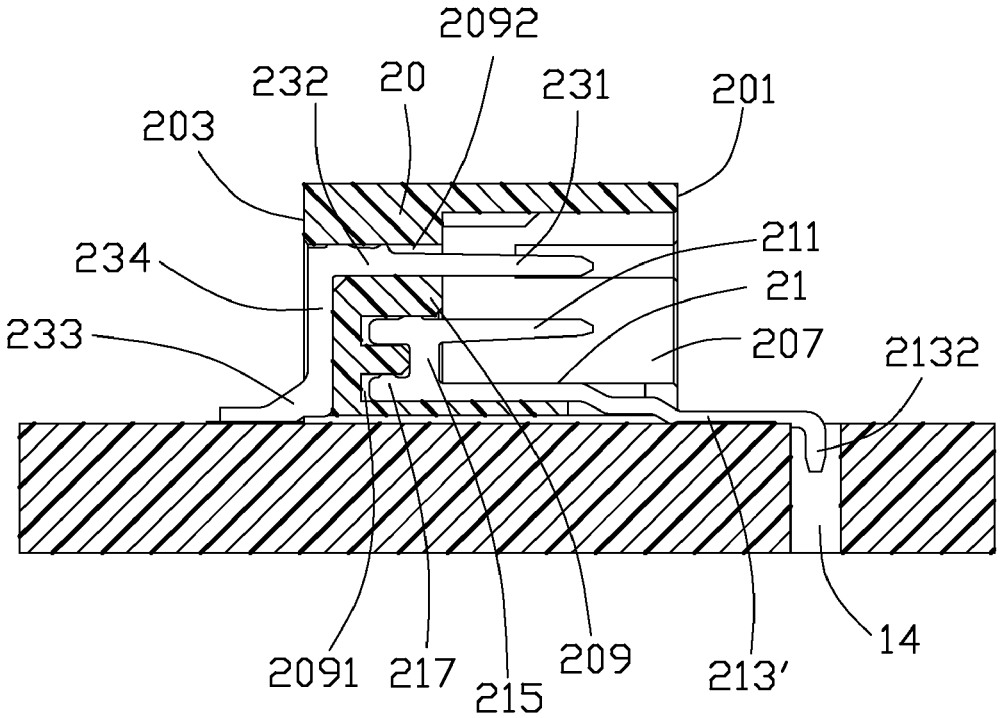
FIG. 4 is a cross sectional view of the electrical connector taken along line 4-4 in FIG. 1.

Referring to FIGS. 1-3, the contacts (22) comprise a plurality of first contacts (21) and second contacts (23). Each first contact (21) defines a first contacting portion (211) located in the receiving cavity (207), a first soldering portion (213) extending out of the housing (20) from the mating face (201) and parallel to the contacting portion (211), a first connecting portion (215) perpendicular to the first soldering portion (213) and connecting a rear end of the first contacting portion (211) and a rear end of the first soldering portion (213), and a pair of retaining portions (217) respectively extending from the rear end of the first contacting portion (211) and the rear end of the soldering portion (213). Referring to FIG. 4, a rear wall (209) of the receiving cavity (207) defines a first retaining groove (2091) receiving the two retaining portions (217) and the connecting portion (215) to secure the first contacts (21) to the housing (20). Each first contact (21) is configure with an inverted H-shaped manner and assembled in a front-to-rear direction to the housing (20). The soldering portions (213) are connected with the welding areas (12). At least one pair of first soldering portions (213') of the first contacts (21) further comprise board-lock portions (2132) extending from front ends of the soldering portions (213') and perpendicular to the soldering portions (213'). The board-lock portion (2132) is inserted into and/or welded in the through hole (14) of the PCB (1). When a mating electrical connector (not shown) is inserting in the front-to-rear direction into the receiving cavity (207), the board-lock portions (2132) perpendicular to the insertion direction are grabbed with the PCB (1) to prevent the electrical connector (2) from moving rearwards due to a mating force. The first contacts (21) with the first soldering portions (213') are close to sides of the housing (20).

Each second contact (23) comprises a second contacting portion (231) received in the receiving cavity (207), a second retaining portion (232) at a rear end of the second contacting portion (231) and parallel to the second contacting portion (231), a second soldering portion (233) extending out of the housing (20) from the rear face (203) and welded to the PCB (1), and a second connecting portion (234) perpendicular to the second contacting portion (231) and connecting the second retaining portion (232) and the second soldering portion (233). The rear face (203) of the housing (20) defines a second retaining groove (2092) receiving the second retaining portion (232) and the second connecting portion (234). The first contacts (21) are located at a frontward and downward position with respect to the second contacts (23).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector secured to a PCB having welding areas and through holes, comprising:

an insulative housing defining a receiving cavity;

a plurality of contacts arranged in the housing, each of said contacts defining a contacting portion received in the receiving cavity, a soldering portion extending out of the housing to be connected with the welding area and a connecting portion perpendicular to the soldering portion which is connecting the contacting portion and the soldering portion; wherein at least one of said contacts further comprises a board-lock portion bending from a distal end of the soldering portions which is adapted for inserting in the through hole of the PCB.

2. The electrical connector as claimed in claim 1, wherein the board-lock portion is soldered in the through hole.

3. The electrical connector as claimed in claim 2, wherein the contacting portion is parallel to the soldering portion.

4. The electrical connector as claimed in claim 3, wherein the contact defines a pair of retaining portions respectively at a rear end of the contacting portion and a rear end of the soldering portion and retained in a rear wall of the receiving cavity.

5. The electrical connector as claimed in claim 4, wherein the board-lock portion is extending from a front end of the soldering portion and received in the through hole in front of welding area of the PCB.

6. The electrical connector as claimed in claim 1, wherein the electrical connector further comprises a plurality of second contacts located at a rearward and upward position with respect to the first contacts.

7. An electrical connector secured to a PCB, comprising:

an insulative housing defining a front mating face and a rear face opposite to the mating face;

a row of contacts inserting into the housing from the mating face and defining contacting portions behind the mating face and soldering portions extending out of the housing from the mating face; wherein at least one of said contacts further comprises a board-lock portion at a distal end of the soldering section and perpendicular to the direction of the contacts inserting into the housing.

8. The electrical connector as claimed in claim 7, wherein the electrical connector further comprises a second row of contacts inserted into the housing from the rear face.

9. An electrical connector comprising:

an insulative housing defining a mating port horizontally and forwardly communicating with an exterior via an exterior face of the housing;

an interior face formed on the housing and directly forwardly confronting said mating port;

a row of passageways formed in the housing behind the interior face; and a row of contacts disposed in the housing, each of said contacts defining a mating pin extending forwardly from the interior face into the mating port, a connecting portion linked to the mating pin and extending downwardly, a soldering portion extending forwardly from the connecting portion and beyond the exterior face, and at least one retaining portion rearwardly extending behind the connecting portion and into the housing for retaining the contact to the housing so as to allow each of said contacts to be assembled to the housing in a front-to-back direction.

10. The electrical connector as claimed in claim 9, wherein some of said contacts further includes a board-locking portion downwardly extending from a front distal end of the soldering portion for receipt within a hole in a printed circuit board on which said housing is mounted.

11. The electrical connector as claimed in claim 9, wherein there are two said retaining portions behind the connecting portion and cooperate with the mating pin and the solder portion to form a "H" like structure.

12. The electrical connector as claimed in claim 11, further including another row of contacts above said row of contacts, wherein each of said another row of contacts defines a Z-like structure and assembled to the housing forwardly from a rear face of the housing.

* * * * *